US007234842B2

(12) United States Patent
Frederico

(10) Patent No.: US 7,234,842 B2
(45) Date of Patent: Jun. 26, 2007

(54) REPLACEABLE LED SOCKET TORCH AND LIGHTING HEAD ASSEMBLY

(76) Inventor: Tom Frederico, 1368 Tarpon St., Foster City, CA (US) 94404

( * ) Notice: Subject to any disclaimer, the term of this patent is extended or adjusted under 35 U.S.C. 154(b) by 127 days.

(21) Appl. No.: 11/191,802

(22) Filed: Jul. 28, 2005

(65) Prior Publication Data

US 2007/0081337 A1 Apr. 12, 2007

(51) Int. Cl.

| | |
|---|---|
| ***F21S 8/00*** | (2006.01) |
| ***F21V 3/00*** | (2006.01) |
| ***F21V 29/00*** | (2006.01) |
| ***F21V 21/16*** | (2006.01) |

(52) U.S. Cl. ..... 362/277; 362/311; 362/373; 362/407

(58) Field of Classification Search ..... 362/373, 362/270, 280, 294, 406, 407, 408, 187, 258, 362/277, 319, 512; 257/706

See application file for complete search history.

(56) References Cited

U.S. PATENT DOCUMENTS

| | | | | |
|---|---|---|---|---|
| 6,068,385 | A * | 5/2000 | Hsieh | 362/188 |
| 6,481,874 | B2 * | 11/2002 | Petroski | 362/373 |
| 6,991,350 | B2 * | 1/2006 | McInnis | 362/362 |
| 7,121,680 | B2 * | 10/2006 | Galli | 362/202 |
| 7,138,667 | B2 * | 11/2006 | Barnett et al. | 257/99 |
| 2002/0141197 | A1 | 10/2002 | Petroski | |
| 2004/0090785 | A1 | 5/2004 | McInnis | |
| 2004/0114393 | A1 | 6/2004 | Galli | |
| 2005/0094328 | A1 * | 5/2005 | Weiss et al. | 361/2 |
| 2006/0274520 | A1 * | 12/2006 | Dalton et al. | 362/157 |

OTHER PUBLICATIONS

Thermal Design Using Luxeon Power Light Sources App Brief AB05 (Jan. 2005), Luxeon Power Light Sources, Jan. 2005, 12 page(s).

"Lumileds Thermal Breakthrough—No heat sink required", Lumileds Lighting press release, Mar. 29, 2005, 2 pages(s).

"Lumileds Shatters Performance Records with Release of 190 lumen Luxeon III", Lumileds Lighting press release, Mar. 31, 2005, 2 page(s).

* cited by examiner

*Primary Examiner*—Jayprakash Gandhi
*Assistant Examiner*—Sean P. Gramling

(57) ABSTRACT

A replaceable lighting head assembly comprised of a high output LED (Light Emitting Diode) socket torch package, vertically aligned thermal heat sink, and electrical connector coupled with a secondary housing unit that conducts heat received from the heat sink to the external environment and acts as a conduit for the external electrical source. This second component also serves as a building block for further fixture design. In this manner, state-of-the-art LED's can be used to provide light within a small, durable package which in turn, provides lighting designers with the opportunity to explore new fixture designs and to improve the quality, energy-efficiency, safety and longevity of existing products.

7 Claims, 16 Drawing Sheets

REPLACEABLE LED SOCKET TORCH AND LIGHTING HEAD ASSEMBLY

FIELD OF THE INVENTION

The present invention relates to a new assembly for packaging a high power dimmable LED light source that can be further incorporated into a larger lighting assembly. More specifically, this invention relates to a replaceable lighting head assembly comprised of a high output LED socket torch, a vertically aligned thermal heat sink and an electrical connector.

BACKGROUND OF THE INVENTION

The present invention relates to a new assembly for packaging a high power dimmable LED light source that can be further incorporated into a larger lighting assembly. More specifically, this invention relates to a replaceable lighting head assembly comprised of a high output LED socket torch, a vertically aligned thermal heat sink and an electrical connector. In itself, this section acts as an electrical interconnect as well as a thermal heat sink interface suitable for small package integration. The secondary housing unit of this assembly provides a thermal pathway for the heat received from the heat sink to the external environment and acts as a conduit for easy access to the external electrical source. If desired, it can also act as a base for further fixture design functions. This assembly, when integrated into the design of a light housing, provides a means by which to manipulate the light beam of the lighting fixture.

The evolution of electric lighting began in the late 1800's with the first incandescent bulb—essentially a "glowing wire in a bottle". In spite of all the improvements, the light bulb that we use today is really not much different than the one invented by Thomas Edison. Inherent problems such as premature failures due to delicate glass structure or filaments, environmental concerns with the mercury, lead or toxic and flammable gases used, and intrinsic inefficiencies are still a concern. Less than 10% of the energy required to burn an incandescent light bulb is converted to light. Even flourescent lighting—today's most efficient light source, converts only 30–40% into light. Although not yet at the levels of flourescent lighting, LED's have the potential to convert up to 90% of the energy they receive into light. Further, light from conventional sources is emitted in all directions, requiring the use of optics to re-direct the beam in the desired direction for effective illumination. Each time the light is redirected, fixture efficiency decreases. The light generated by an LED, however, is directional so its efficiency doesn't have to necessarily match other light sources to be more effective.

Much of the energy a standard filament light source consumes is converted into hot infrared rays that radiate out within the light beam, thus requiring extra caution when handling the bulb. Because of the heat generated, restrictions to the type and size of the casing around these bulbs must be maintained—all of which reduce the flexibility of the lighting system.

Since the human eye is naturally drawn to the brightest source of illumination, flexibility is often required in the distribution of the light. General and accent lighting applications utilize this premise to direct the attention of the viewer to particular areas or items. If the first thing a viewer sees is the harsh light source, then their first impression may be negative. The increased size of the bulb casing results in a larger area from which the light emanates, thus requiring greater attention to positioning of the fixture to avoid direct eye contact with the light source itself.

This flexibility is sometimes related to the light being used in a space that has changing requirements. An example is a retail space where different products are displayed in different ways each week. In this example, spot lights may be desirable for small items and wider beam lights may be appropriate for larger items. The option available today is to use fixtures with integral reflectors that have different beam spreads. One example of this is low-voltage halogen lamps, of which MR-16 is a common type. The MR-16's are available in several light beam spreads from very narrow spot to very wide flood. This strategy causes complications when lamps are changed after burning out. All MR-16's are very similar in appearance, and beam patterns within a space are only maintained after re-lamping if the exact same lamp is used to replace the burned out lamp. This strategy also requires many different lamp types to be kept on hand.

In outdoor lighting, a fixture should be flexible enough to allow landscape or architectural features to be highlighted as elements change, such as when trees or bushes grow—as well as being discrete enough as to not draw the attention of the eye. If not, the resulting brightness one sees actually makes it harder to observe the surrounding environment as it causes everything else to appear darker. Further, traditional light sources have a relatively short life span, necessitating bulb replacement. This can be both time consuming and dangerous if such fixtures are mounted in an elevated position such as on the soffit of a building or high in a tree.

Contrast to that, LED light sources offer small, directional pinpoints of light. Their size and directionality support highly controllable lighting systems capable of delivering high flux output at relatively low current levels for long periods of time. But in order to achieve this, thermal issues associated with high output LED lighting systems must be addressed. The challenge is to conduct the heat generated within the LED onto the fixture and then to dissipate that heat, via convection, to the surrounding ambient air. Proper design, therefore, must be given to the sizing of the heat sink to create both a pleasing aesthetic look and functional heat dissipation.

It would thus be desirable to provide a lighting assembly contained within a small footprint that can be incorporated into various fixture designs. It would be further advantageous if that lighting assembly allows for easy adjustment of the light beam spread in addition to allowing for changes in light intensity through the use of collimating lenses—without having to change the bulb. It would be of further benefit if such assembly were to include a state-of-the-art high output LED for its long life, reduced maintenance cost and reduced cost of ownership—that is replaceable so that when advances in the industry become available the light source can be updated by the consumer.

High output LED light sources are increasingly becoming the choice of illumination. These dimmable solid-state devices have no filament to break or glass to shatter, no mercury, toxic gases or lead to contaminate the environment and no infrared or UV in the light beam. They are fast approaching the efficiency of fluorescent light sources with new performance standards being achieved regularly.

High output LED's differ from conventional LED light sources in that they are able to separate their thermal and electrical pathways. This enables them to draw more heat away from the emitter core and thus significantly reduce thermal resistance. As a result, high output LED's can handle significantly more power than conventional LED's. However, the higher electrical input also means they tend to operate at higher operating temperatures which can degrade their performance. Heat that is not effectively dissipated can shift colors, reduce brightness and significantly shorten their life span.

Moreover, most heat sink configurations currently available are directed to a planar circuit board mount with a heat spreader or a horizontal finned heat sink design. Neither of these arrangements is suitable for small vertical package integration or compact lighting head construction.

ADVANTAGES AND SUMMARY OF THE INVENTION

The present invention is a lighting assembly that provides for heat dissipation to achieve manufacturing efficiencies and product consistencies. The heat dissipating system removes heat from the LED that would otherwise shorten its life and/or reduce its brightness. Further, the present invention provides a lighting assembly wherein the light can be directed onto a single element or expanded to cover a wide area by its adjustable nature when called upon. The present invention further allows for easy replacement of the light source as called for when changes in light output, light pattern, or light color is desired—or as new performance standards are achieved.

The present invention further provides a lighting head assembly that contains a high output dimmable LED socket torch attached to a vertically aligned thermal heat sink interface with a friction lock electrical interconnect. This assembly can be incorporated directly into the design of the fixture housing or inserted into the secondary housing unit to provide a thermal pathway for the heat generated by the LED and to provide for easy access to the external electrical source. This second component also serves as a foundation for additional design features—such as a sliding cylinder that adds further flexibility to the illumination system by allowing the expansion or contraction of the light beam or changing the intensity of the light beam through use of a collimating lens.

The present invention further provides for simplified connection of the light assembly to the external power source and controller. Several controller options are readily available within the industry that allow for use of high power LED's in a variety of operating modes.

Further details, objects and advantages of the present invention will be come apparent through the following descriptions, and will be included and incorporated herein.

DETAILED DESCRIPTION OF EMBODIMENTS

Figure 1:
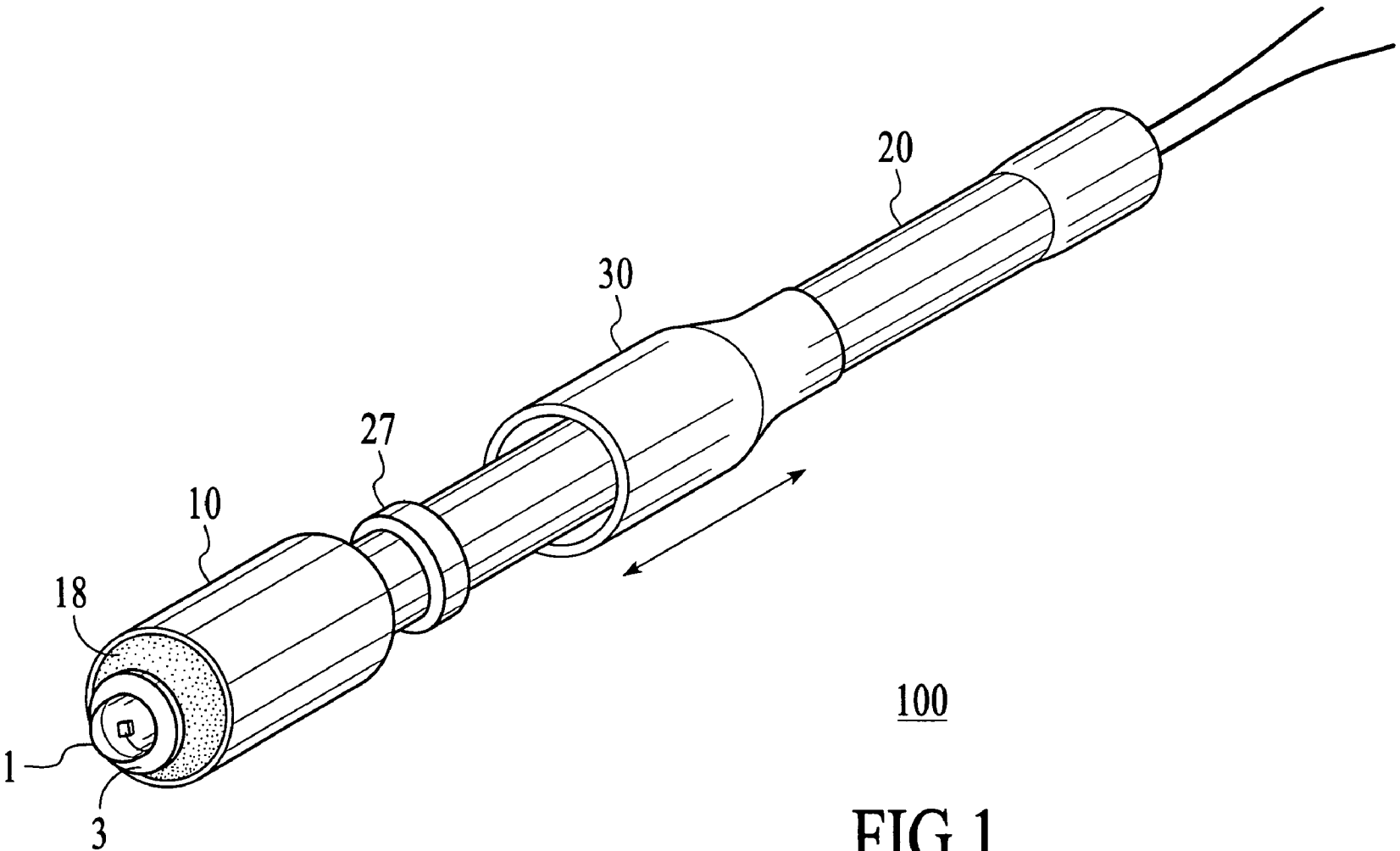
FIG. 1 is a perspective view of one embodiment of the lighting head assembly 100 of the present invention.
Figure 2:
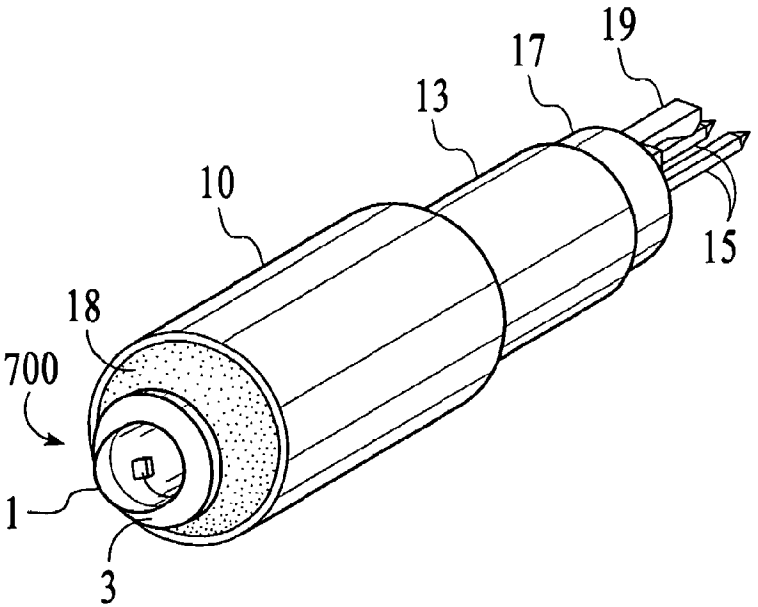
FIG. 2 is a perspective view of one embodiment of the high output LED socket torch 200, vertically aligned thermal heat sink 13 and electrical connector assembly 15 and 19.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

The lighting head assembly 100 includes a high output LED socket torch 200, a vertically aligned thermal heat sink 13, an electrical connector assembly 15 and 19 and coupler 10 that fastens the lighting head assembly 100 to the secondary housing unit 20. A sliding cylinder 30 attaches to the secondary housing unit 20 to provide a base to add various fixture design elements 40, 40*b*, 40*c* and 40*d*.

As will hereinafter be more fully described, the present invention illustrates a lighting head assembly 100 that may be further incorporated into other lighting devices. In general, the present invention 100 is comprised of a replaceable high output LED socket torch 200 that provides essential heat transfer and electrical connectivity to a secondary housing unit 20 that further provides for manipulation of the light beam 400. The present invention 100 therefore provides a convenient and economical assembly that has not been previously available in the prior art.

Figure 8:
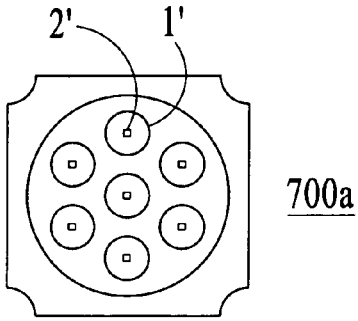
FIGS. 8, 9 and 10 show alternative embodiments of LED emitter packages 700*a*, 700*b* and 700*c*.
Figure 9:
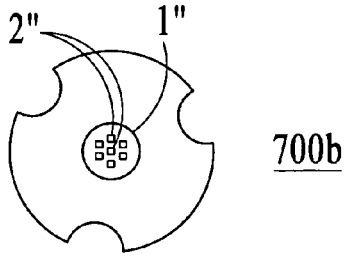
Figure 10:
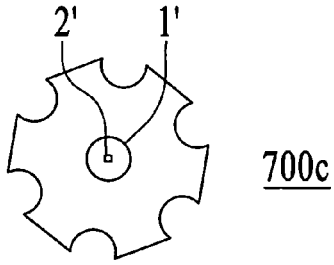
Figure 11:
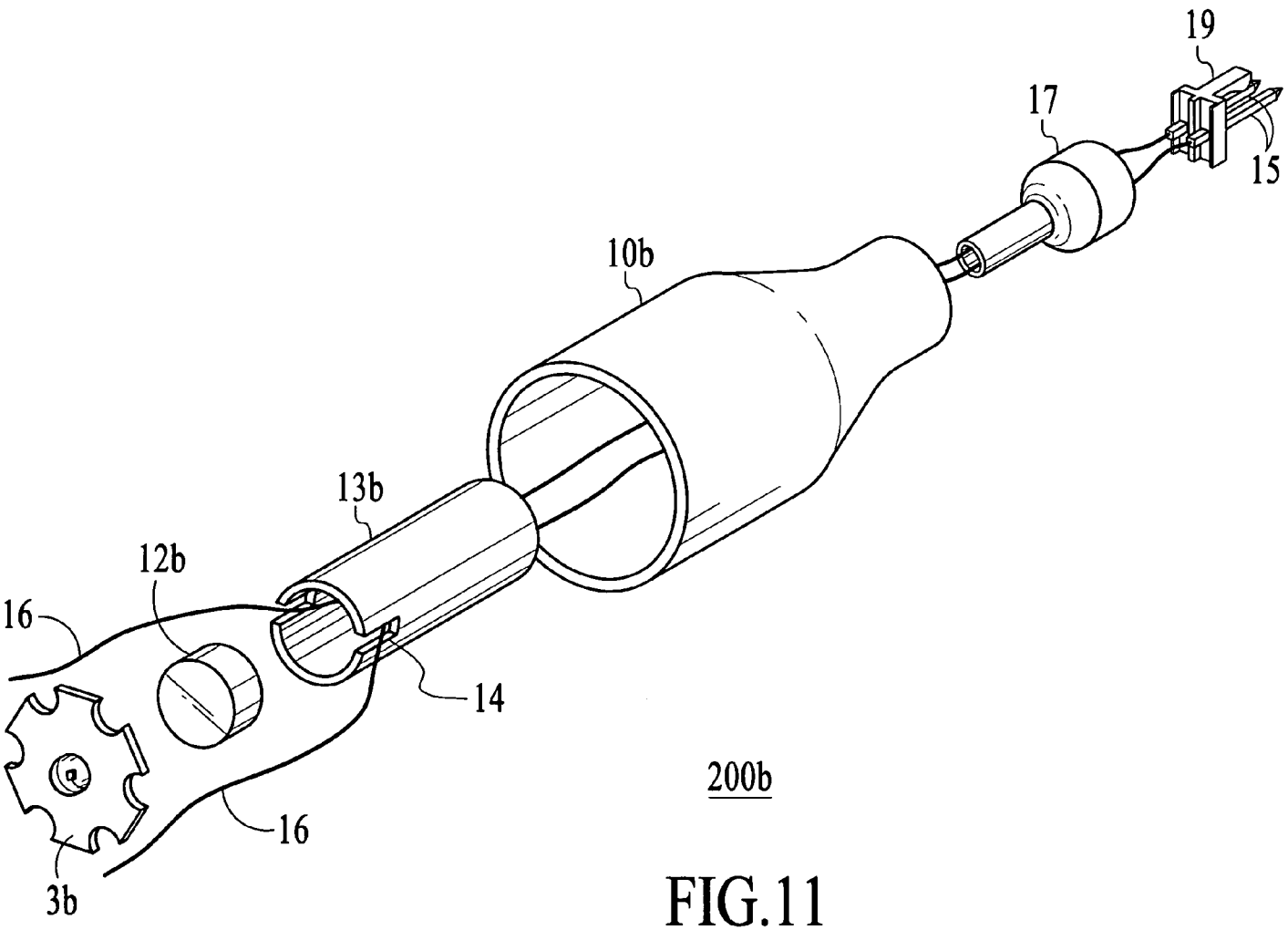
FIG. 11 is an exploded perspective of the high output LED socket torch 200*b* vertically aligned thermal heat sink 13*b* and electrical connector assembly 15 and 19 showing one type of coupler embodiment for alternative LED emitter packages.
Figure 12:
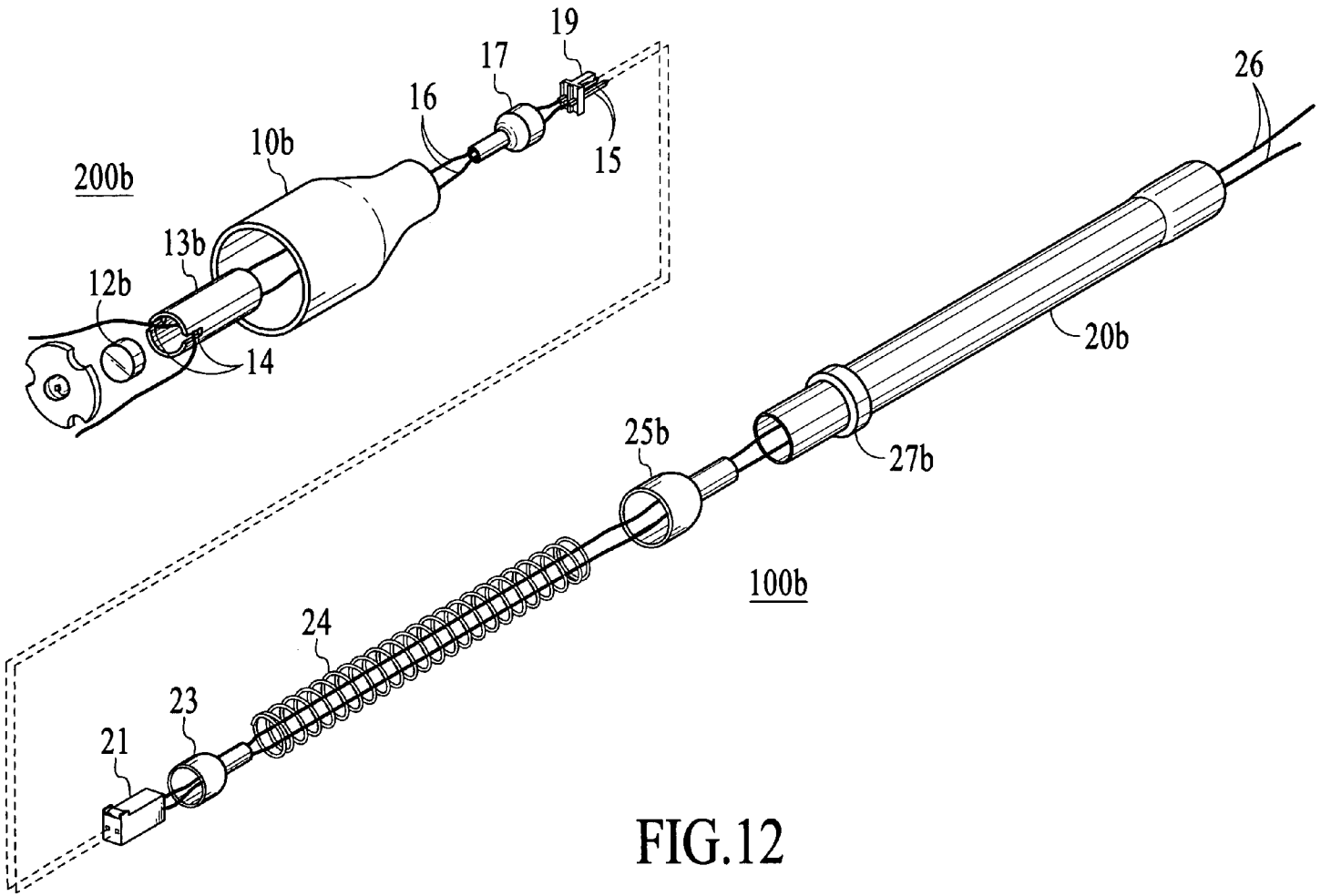
FIG. 12 is an exploded perspective of the lighting head assembly 100*b* using an alternative LED socket torch 200*b* and coupler 10*b* with sliding cylinder 30 removed.

The present invention 100 is specifically configured to incorporate high output LED lamps 700 into a socket torch package that can then be used in a lighting fixture. The high output LED lamp 700 as shown here is a Luxeon emitter. However, it should be understood that the mounting arrangement described is equally applicable to other high output LED lamps 700 as shown in FIGS. 8, 9 and 10.

Figure 7:
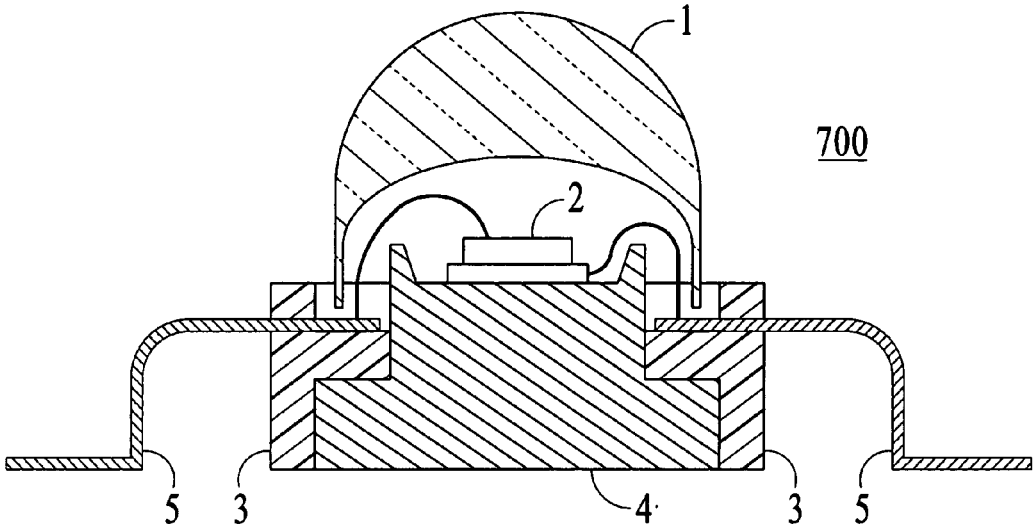
FIG. 7 is a sectional view of one embodiment of the LED emitter package 700.

As shown in FIG. 7, the LED 700 has a mounting base 3 and a plastic lens 1 that encloses the LED emitter chip 2. The LED 700 also includes two contact leads 5 that extend from opposite sides of the mounting base 3 to which power is connected to energize the emitter chip 2. Since the emitter chip 2 in this type of high output LED lamp 700 has a greater surface area than conventional LED's, a great deal more heat is generated along with the increased light output. For this reason, a heat transfer slug 4 for the specific purpose of engagement with a supplementary heat sink 13 is provided. Within the LED 700, the heat transfer slug 4 extends from the base 3 of the emitter chip 2, to the bottom inside surface of the mounting base 3, thus providing an thermal pathway to transfer the heat generated by the emitter chip 2.

Figure 3:
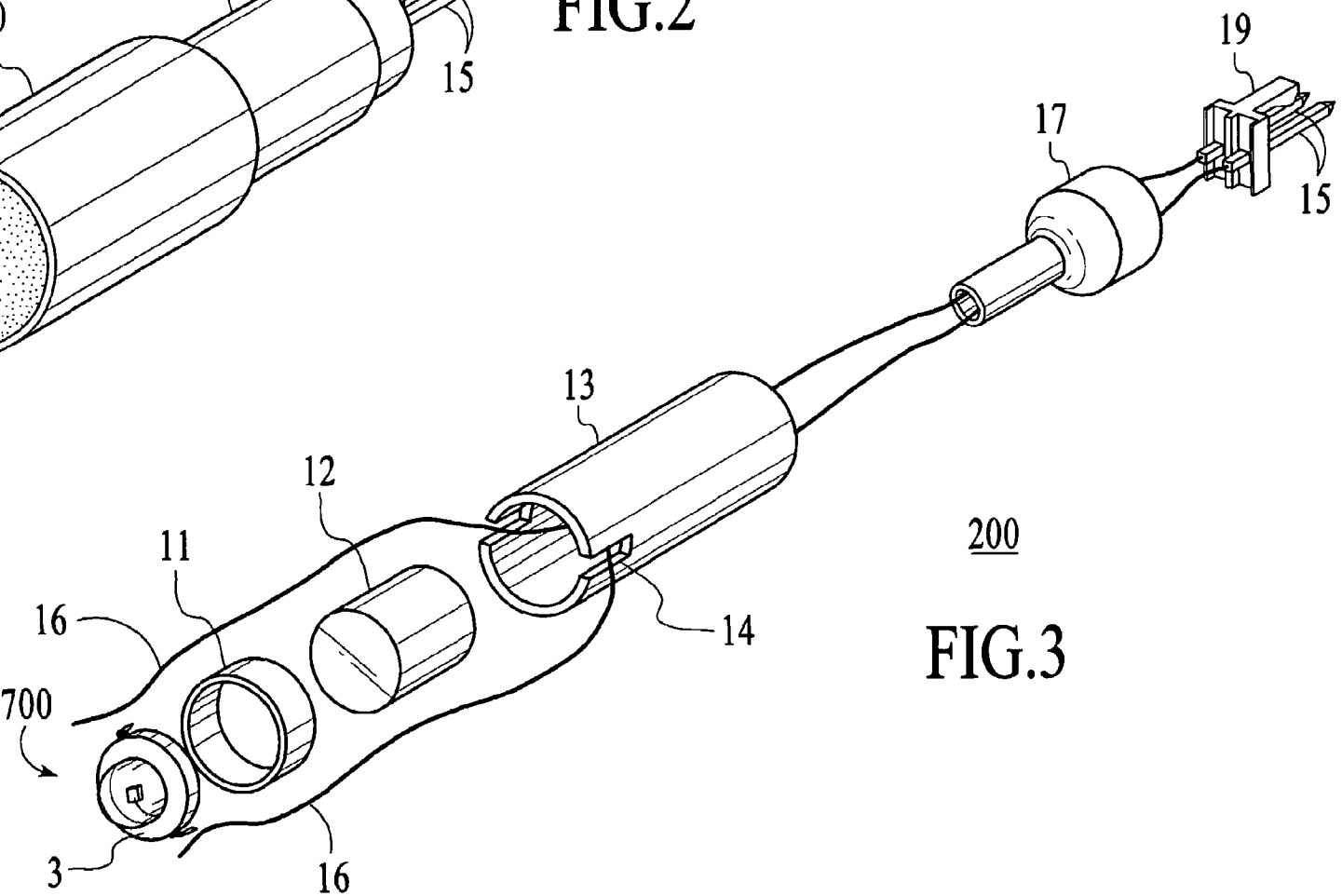
FIGS. 3 and 4 are exploded side perspectives of an embodiment of the high output LED socket torch 200, vertically aligned thermal heat sink 13 and electrical connector assembly 15 and 19 of the present invention 100.

In FIG. 3, the bottom portion of the LED base 3 mounts inside the upper portion of the emitter ring 11, comprised of a thin non-conductive material capable of handling the anticipated temperature range within that area. The remaining portion of the emitter ring 11 then mounts over the heat transfer rod 12, which is made of a thermally conductive solid cylindrical material. The end surface area of the rod 12 is sufficiently polished such that good thermal contact is made with the heat transfer slug 4. In one embodiment, the heat transfer rod 12 is made of aluminum, however, other thermally conductive materials can also be used.

Figure 4:
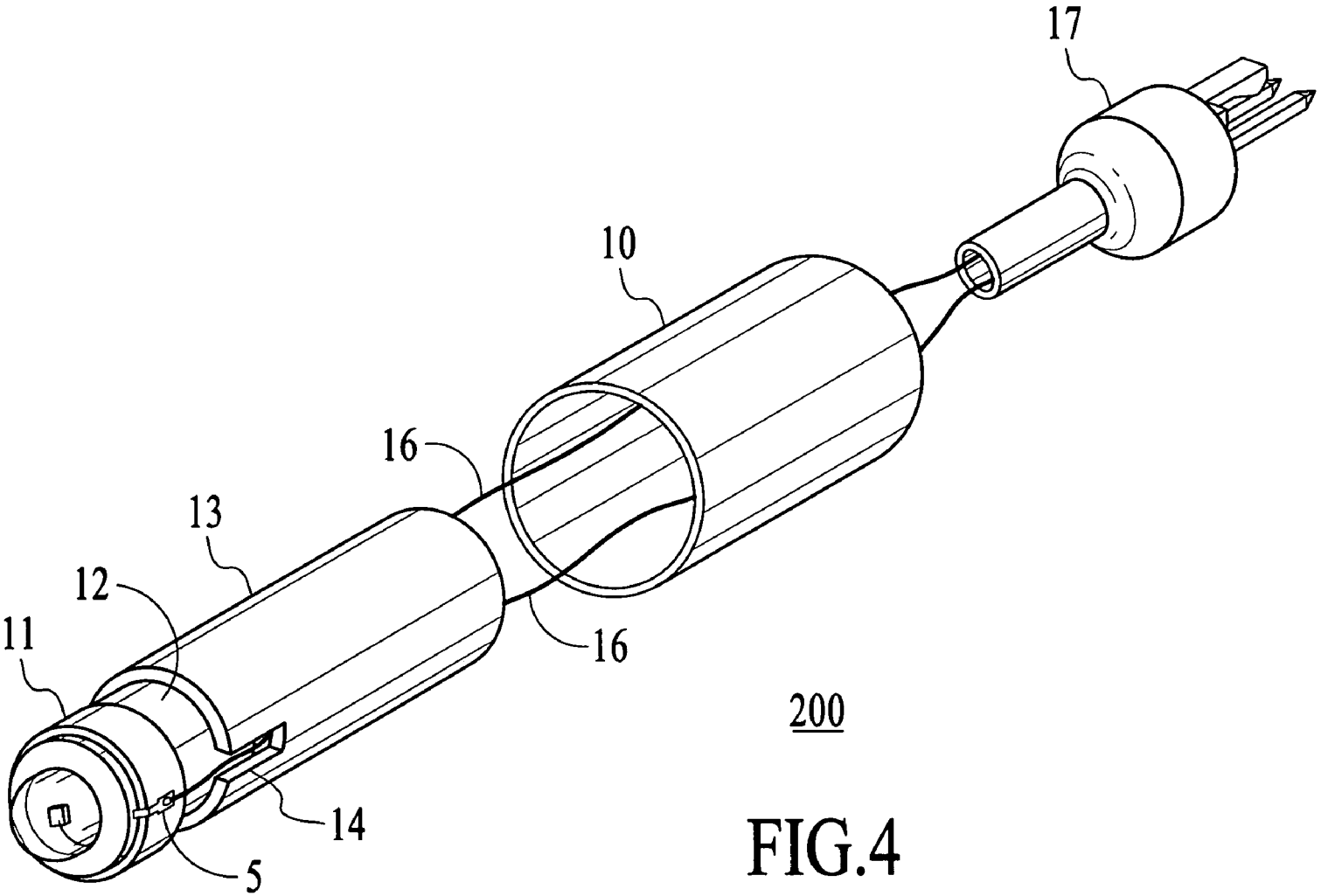

As shown in FIG. 4, the contact leads 5 of the LED 700 are then pressed down over the non-conductive emitter ring 11 surface. The heat transfer rod 12, with LED assembly 700 attached, is then inserted into the tubular vertically aligned thermal heat sink 13 up to the bottom rim of the emitter ring 11.

In one embodiment, the vertically aligned thermal heat sink 13 is cylindrically shaped and extending in a direction to surround the heat transfer rod 12. The outside diameter of the heat transfer rod 12 is slightly less than the inside diameter of the vertically aligned thermal heat sink 13 resulting in an intimate fit between the two thermally conductive materials such that sufficient contact is made to facilitate the transfer of heat from the heat transfer rod 12 to the vertically aligned heat sink 13. In one embodiment, the vertically aligned thermal heat sink 13 is made of aluminum. However, other thermally conductive materials or compounds for improving thermal transfer can also be used.

To further facilitate the transfer of heat and to aid in the strength of the connections, a thermally conductive adhesive or thermal compound may be applied at all heat transfer connections.

A groove 14 is present on opposite sides of one end of the vertically aligned heat sink 13. These grooves extend slightly past the bottom rim of the inserted heat transfer rod 12 and align with the two contact leads 5 that extend from the sides of the LED 700.

The electrical wires 16 of the electrical connector assembly 15 and 19 run inside the vertically aligned heat sink 13, then feed through the cavity created by each of these grooves 14. The wire ends are then soldered to the contact leads 5 of the LED 700 over the area of the non-conductive material of the emitter ring 11 such that no electrical contact is made with the rest of the assembly.

The other end of the electrical wires 16 are connected via soldering to the back end of the pin headers 15 of the vertical friction lock 19. This electrical connector assembly 15 and 19 is then encased within the 14–22 AWG nylon closed end connector 17 that has the tip of its stem opened to allow the electrical wires 16 to pass. In one embodiment, the 14–22 AWG nylon closed end connector 17 serves to center and contains the vertical friction lock for mating with the crimp terminal housing 21. It should be understood that this function can be achieved using various alternatives materials. An anti-oxidant grease can be applied to each of the soldered connections and then covered with a non-conductive heat shrink material or similar electrically isolating material.

Figure 5:
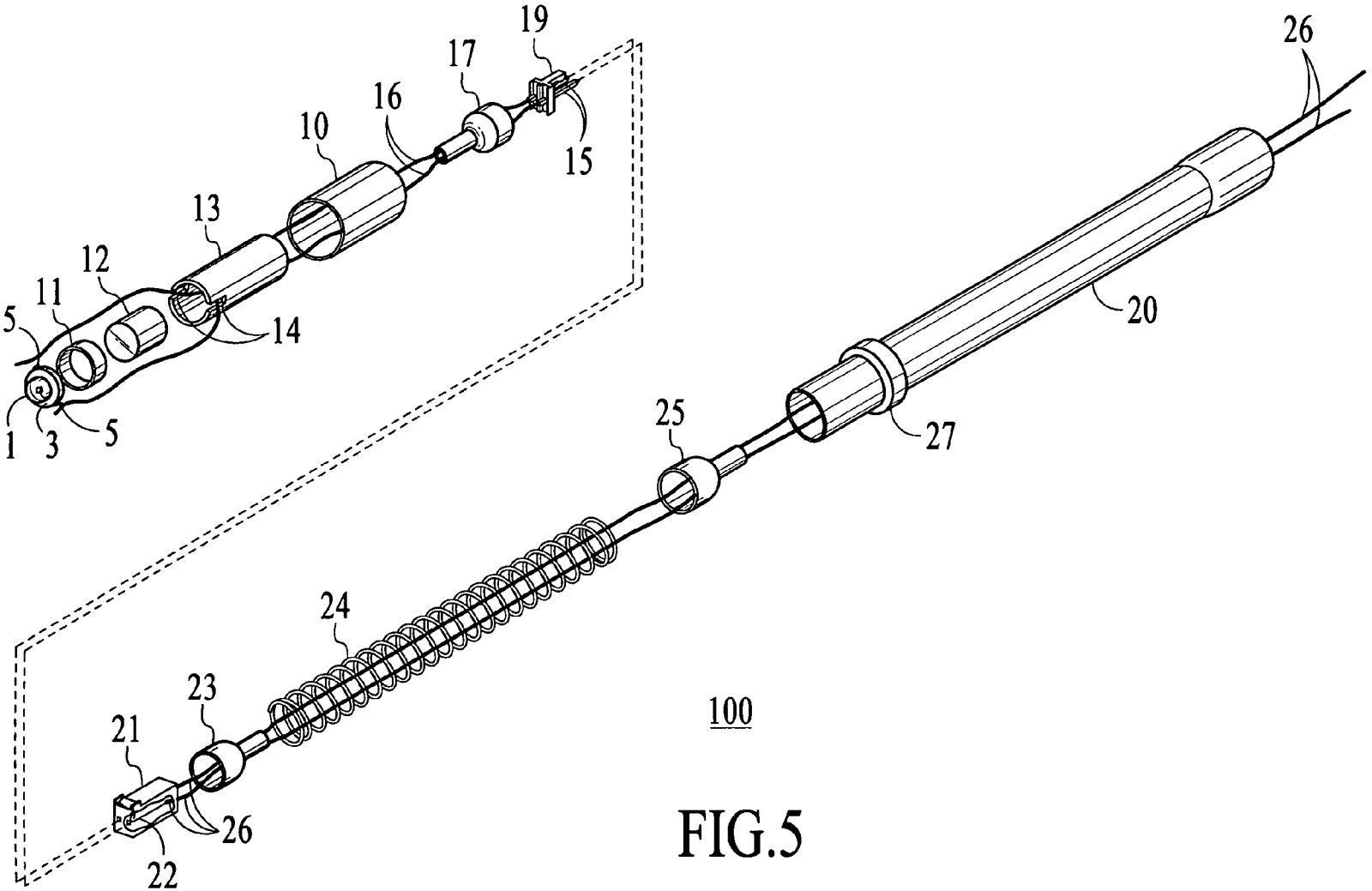
FIG. 5 is an exploded perspective of one embodiment of the lighting head assembly 100 with sliding cylinder 30 removed.
Figure 6:
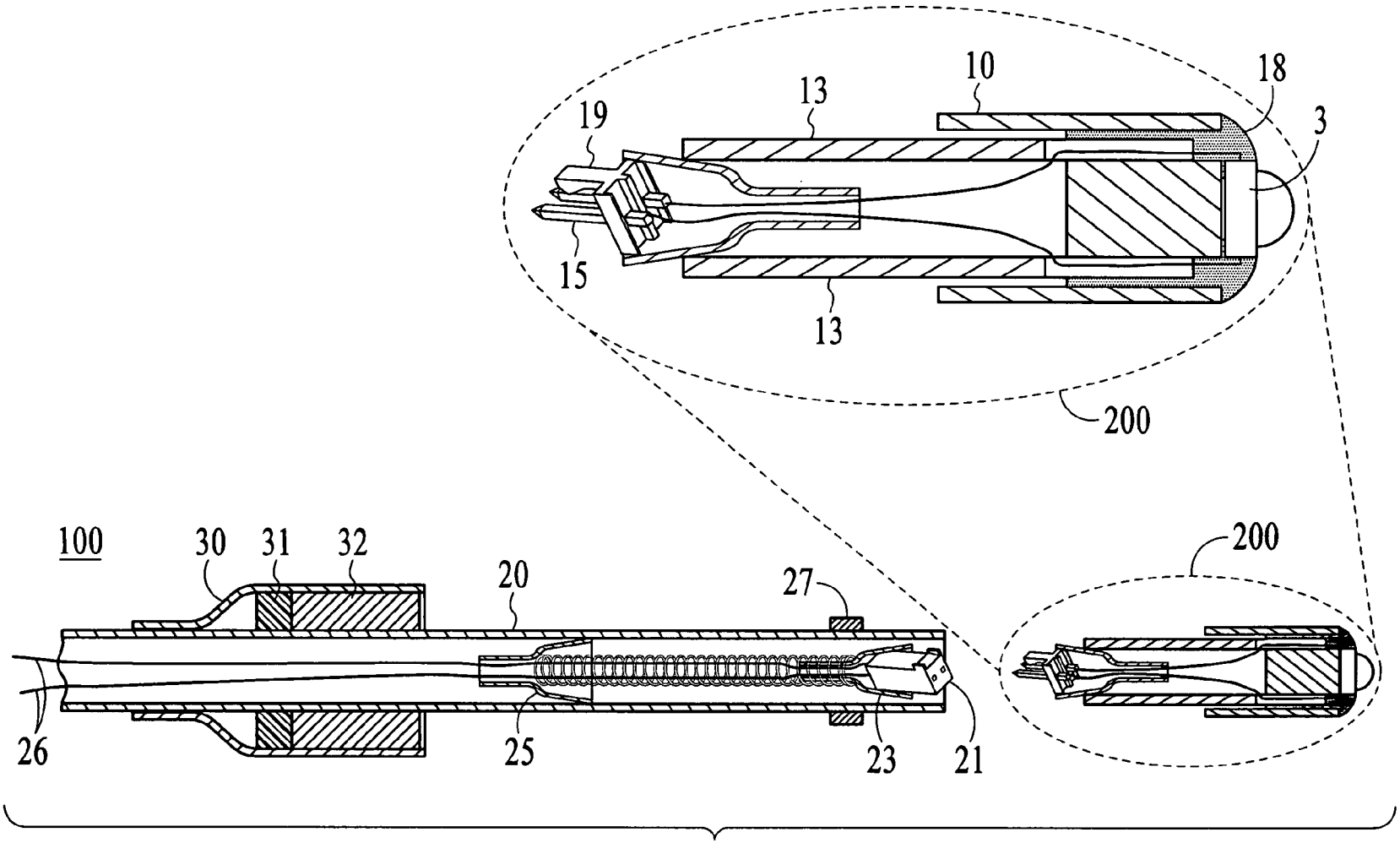
FIG. 6 is a cross-sectional view of the lighting head assembly 100 with sliding cylinder 30 in place.

As shown in FIGS. 4, 5 & 6, electrical connector assembly 15 and 19 and 14–22 AWG nylon closed end connector 17 are then placed inside the coupler 10 so that the upper rim of the coupler 10 extends up to the bottom portion of the LED base 3, covering the emitter ring 11, the soldered connections of the two contact leads 5, the heat shrink material and the grooves 14 of the vertically aligned thermal heat sink 13. The upper half of the coupler 10 is then filled with a non-conductive potting epoxy 18 to encapsulate the area. The bottom half of the coupler 10 is left un-potted to allow coupling to the secondary housing unit 20.

As shown in FIGS. 5 and 6, a sliding cylinder ring stop 27 is attached to the secondary housing unit 20 just beyond the reach of the bottom rim of the coupler 10 to prevent its dislodging by the sliding cylinder 30 when the lighting head assembly 100 is inserted. In one embodiment, the coupler 10 is of an electrically conductive metal material requiring separation from the soldered connections. Alternatively, if the coupler 10 is not intended to aid in the dissipation of heat in the overall fixture design, the coupler 10 can be made of a non-electrically conductive material. In which case the use of the electrically isolating material would not be necessary.

It will be understood by those skilled in the art that any type of flared or shaped glare shield can be utilized in the present invention by coupling directly to the slidable cylinder 30 in order to focus, shape or direct the light emitted therefrom. Thus, an auxiliary flared or shaped glare shield can be moved backward and forward, along the secondary housing unit 20, and over and around the LED socket torch portion 200 of the lighting head assembly of the present invention. The present invention provides a sliding cylinder 30 disposed around or on top of the secondary housing unit portion 20 in which any LED socket torch package or bulb 200 of the present invention can be utilized. Thus, depending upon the shape of an adapter glare shield fitting attached to the sliding cylinder 30, the combination of sliding cylinder 30 and flared or shaped glare shield or beam shaper or other lens fitting can slide down over the LED light torch socket 200 in order to focus, shape, broaden or narrow the beam of light emitted therefrom.

As shown in FIGS. 8, 9 and 10, 11 and 12, larger LED lamps 700*a*, 700*b* and 700*c* can be accommodated within the lighting head assembly 100 by scaling the components including LED base 3*b*, coupler 10*b*, heat transfer rod 12*b*, thermal heat sink 13*b*, secondary housing unit 20*b*, nylon closed end connector 25*b* and sliding cylinder stop 27*b* to fit the size of the LED lamps 700*a*, 700*b* and 700*c*.

In one embodiment, a single LED may comprise a plurality of emitter chips. Often red diode(s) are placed with green diode(s) and blue diode(s). In other cases, other combinations of colors can be used. As shown in FIG. 8, the LED lamp 700*a* has a single emitter chip 2' within each lens 1'. In the LED lamp 700*b* shown in FIG. 9, a single lens 1" houses multiple emitter chips 2".

The replaceable high output LED socket torch 200 is inserted into the secondary housing unit 20 to provide thermal transfer of the heat sink 13 to the external environment or can be inserted into a thermal design embodied within a fixture that is equally effective.

In one embodiment, the vertically aligned thermal heat sink 13 is cylindrically shaped. The outside diameter is slightly less than the inside diameter of the secondary housing unit 20 resulting in an intimate fit between the two thermally conductive materials when inserted. Therefore, when inserted, heat from the vertically aligned thermal heat sink 13 is conducted to the secondary housing unit 20 and then released to the environment through convection. A heat sink compound can be applied to further aid in the heat transfer. Further, if a permanent connection is desired, then a heat sink adhesive can be applied.

It should be understood that the mounting arrangement described is equally applicable to various dimensions and shapes of the mating units as long as the fit allows for the thermal transfer of heat.

The replaceable high output LED socket torch 200 is electrically connected to the secondary housing unit 20 through connection of the electrical connector assembly 15 and 19 and the crimp terminal housing 21, as best shown in FIG. 5.

Another embodiment shown in FIGS. 5 & 6 illustrates the lower portion of the crimp terminal housing 21 encased in a 14–22 AWG or similar nylon or other material closed end connector 23 that has the tip of its stem opened to allow the electrical wires 26 to pass. In one embodiment, 14–22 AWG nylon closed end connector 23 serves to align the crimp terminal housing 21 within the secondary housing unit 20 and provides a means to connect the spring 24 to the crimp terminal housing 21.

Also as shown in FIG. 5, the spring 24 provides insertion resistance necessary for mating of the pin headers 15 of the vertical friction lock 19 to the wire crimp terminals 22 found within the crimp terminal housing, and aids in the positioning of the crimp terminal housing 21 for accepting the vertical friction lock 19 of the electrical connector assembly 15 and 19 At the base of the spring 24 is a 12–10 AWG nylon closed end connector 25 that has the tip of its stem opened to allow the electrical wires 26 to pass. The 12–10 AWG nylon closed end connector 25 serves to center and contain the spring 24 at its proper depth although other means could achieve the same desired effect.

Electrical wire leads 26 extending beyond the secondary housing unit 20 provide connection of the light assembly 100 to a variety of external power sources and controllers. Several options are readily available within the industry that allow for use of high output LED's in a variety of operating modes and wiring configurations. Alternate assemblies could use additional wiring to connect multiple LED emitter chips that are packaged within a single die 700*a* or within a single cavity 700*b*. Therefore, combinations of 2 or more wires might be used to individually control each emitter chip within the LED die.

As shown in FIGS. 6, 13, 14, 15 and 16, the cylindrical shape of the secondary housing unit 20 allows for a cylindrically shaped coupler to be manipulated up or down its length. In one embodiment a sliding cylinder 30 is added to the secondary housing unit 20 to provide a means by which to manipulate the light beam 400 and/or aid in the transfer of heat to the environment.

One opening of the sliding cylinder 30 aligns the shaft of the secondary housing unit 20 to fit within a friction ring 31 used to avoid metal to metal contact when the secondary housing unit 20 is manipulated within the sliding cylinder 30. In one embodiment, the friction ring 31 is comprised of High Density Polyethylene (HDPE) tubing for its excellent chemical, fatigue, wear resistance and heat tolerance. Other materials could serve the same purpose of providing sufficient frictional grip to prevent the secondary housing unit 20 from slipping once it is positioned, while still allowing for shaft movement when desired.

The friction ring 31 is held in place on one end by the narrowing cavity of the sliding cylinder 30, and on the other by the thermally conductive friction ring lock 32. The inside diameter of the friction ring lock 32 is slightly greater than the outside diameter of the secondary housing unit 20 and the outside diameter of the friction ring lock 32 is slightly smaller than the inside diameter of the sliding cylinder 30 resulting in an intimate fit between the thermally conductive materials. Therefore, the friction ring lock 32 serves to transfer heat from the secondary housing unit 20 to the sliding cylinder 30. The friction ring 31 can also be locked in place by use of a supplementary fixture design element 40*c* that attaches to the inside of the sliding cylinder 30.

It should be understood that the mounting arrangement described is equally applicable to sliding couplers of differing designs, shapes and sizes.

Figure 13:
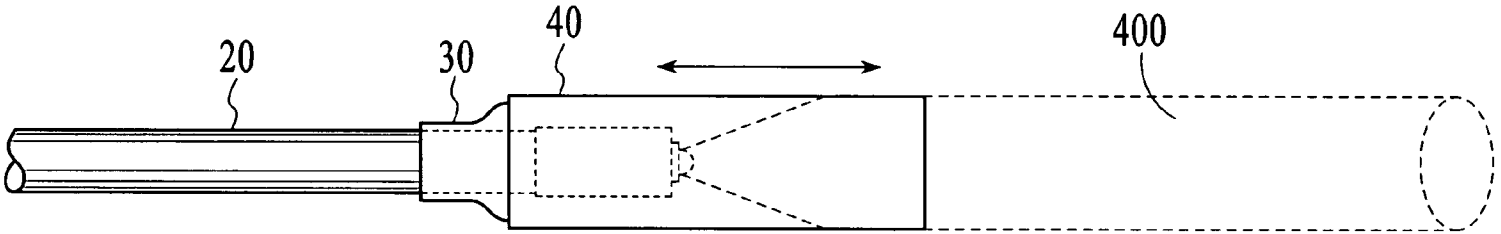
FIGS. 13, 14 and 15 are side views of a complete lighting head assembly 100 with a tubular supplementary fixture design element 40 attached to the sliding cylinder 30 showing the contraction and expansion of the light beam 400.
Figure 14:
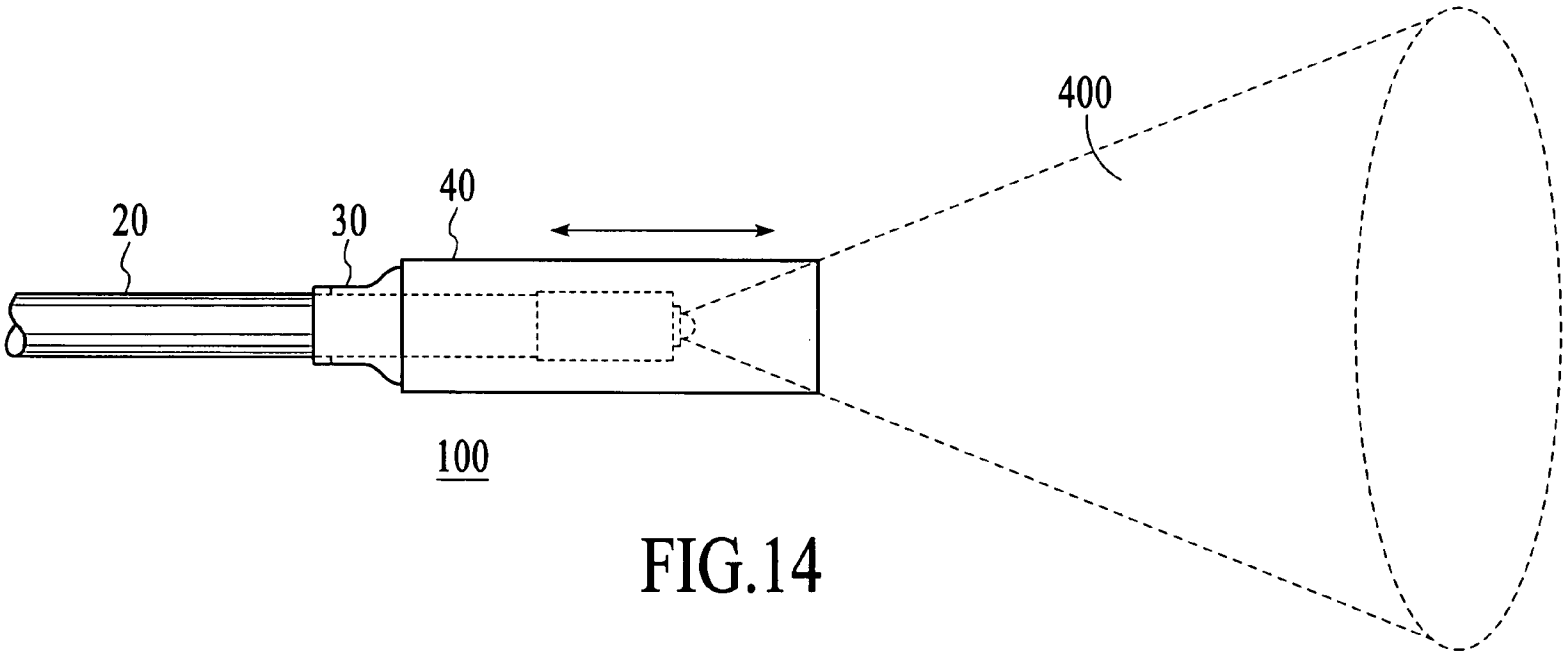
Figure 15:
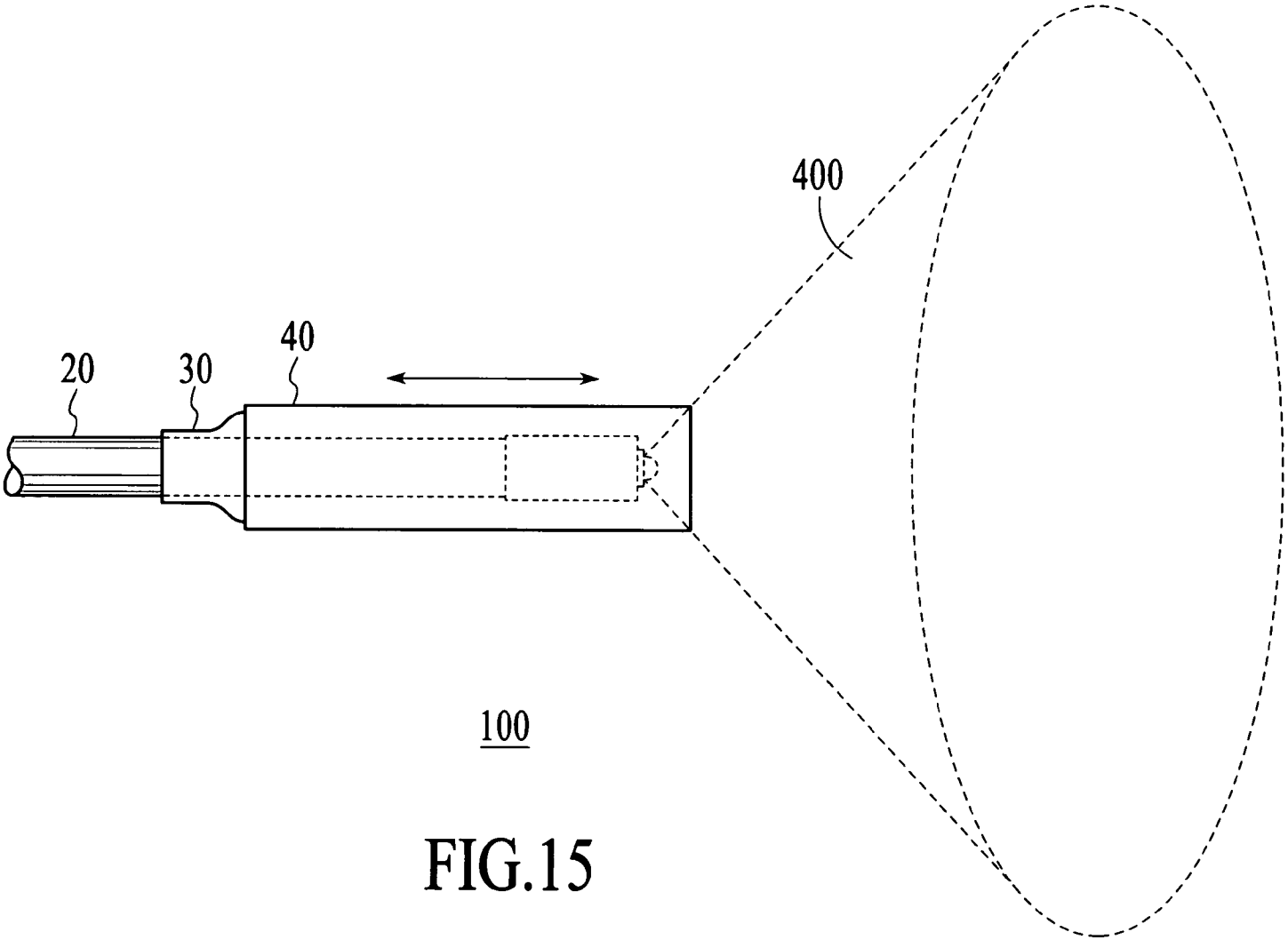

In one embodiment, as shown in FIGS. 13–16, the sliding cylinder 30 serves as a base on to which additional design elements can be attached. By adding a removable tubular glare shield 40 over or within the flared opening of the sliding cylinder 30 and sliding it up and down the shaft of the secondary housing unit 20, the LED 700 can be manipulated to the forefront or backmost region of the glare shield 40 to produce a light beam 400 that alters from spot as shown in FIG. 13 to flood as shown in FIG. 15. Alternatively, the sliding cylinder 30 itself can be shaped to achieve the above-mentioned functions.

Figure 16:
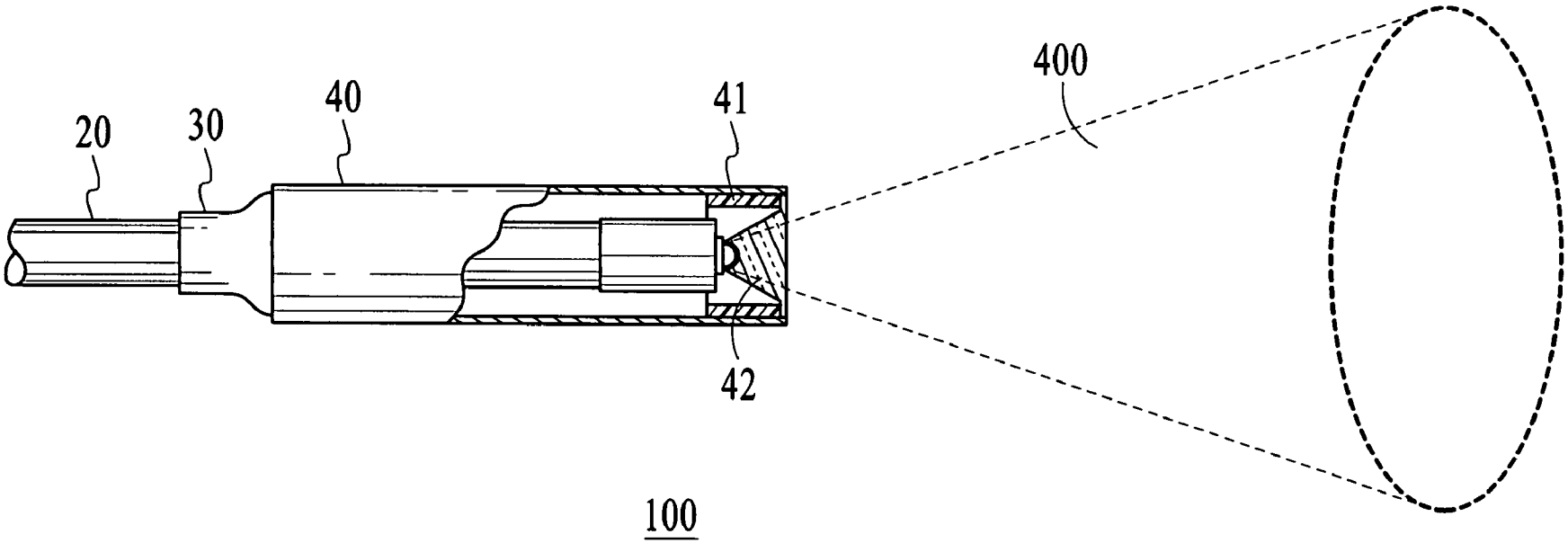
FIG. 16 is a side view of the complete lighting head assembly 100 and one embodiment with a tubular supplementary fixture design element 40 attached to the sliding cylinder 30 and a collimating lens 42 inserted to manipulate the size and intensity of the light beam 400.

As best shown in FIG. 16, by inserting one of the many collimating lenses 42 and their supplementary lens holders 41 readily available in the industry within the removable glare shield 40, the shape and intensity of the light beam 400 can be further manipulated within set patterns.

Figure 17:
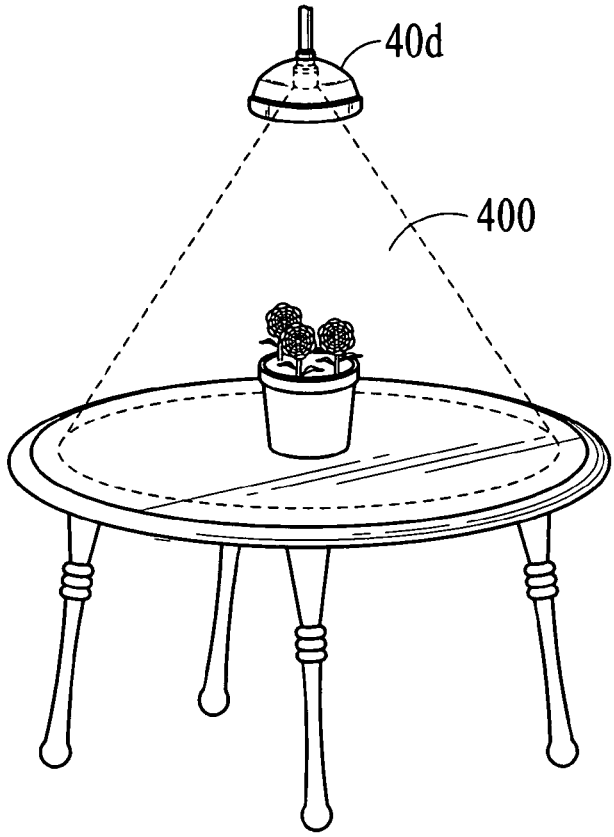
FIGS. 17 and 18 shows an example of an alternative style element 40*d*, that can be attached directly to the sliding cylinder 30 or supplementary fixture design element 40 and the subsequent manipulation of the light beam 400.
Figure 18:
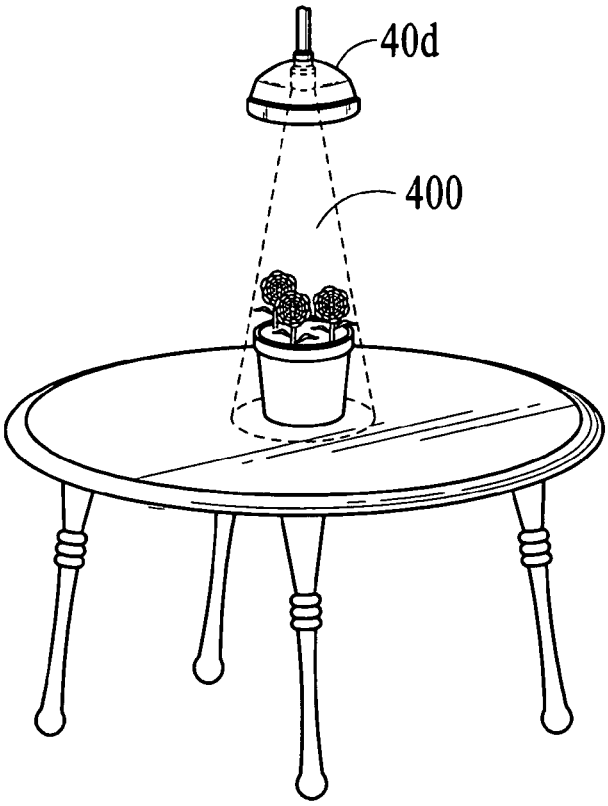
Figure 19A:
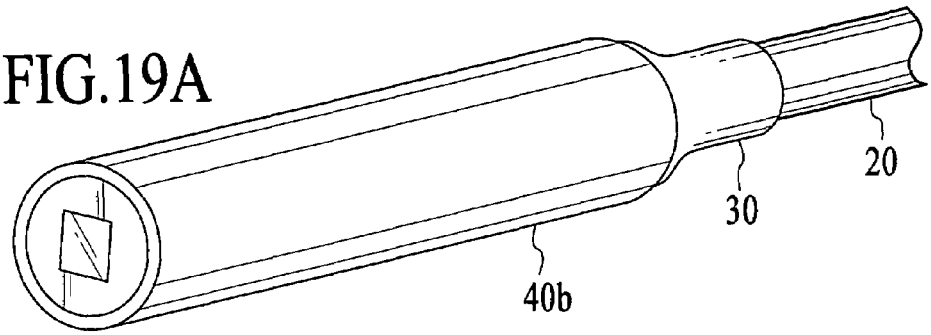
FIGS. 19A, 19B, 19C and 19D show alternative embodiments of lighting head assembly 100 each with a supplementary fixture design element 40*b* with different shaped slit openings attached to the sliding cylinder 30.
Figure 19B:
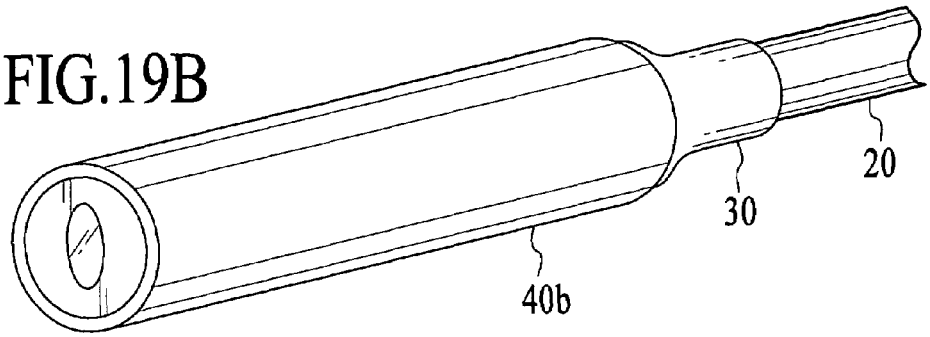
Figure 19C:
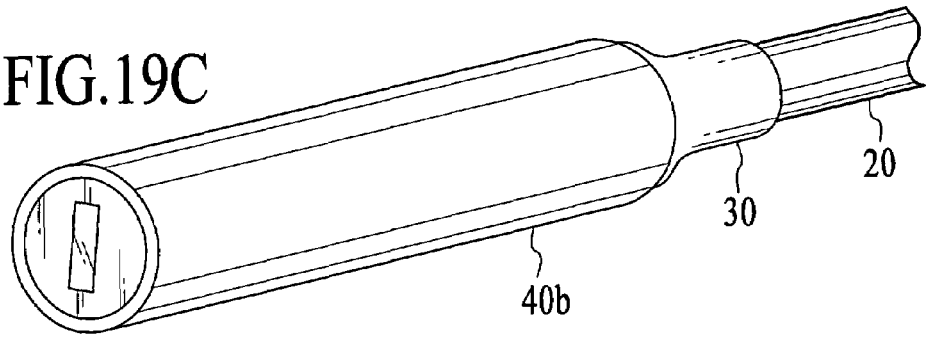
Figure 19D:
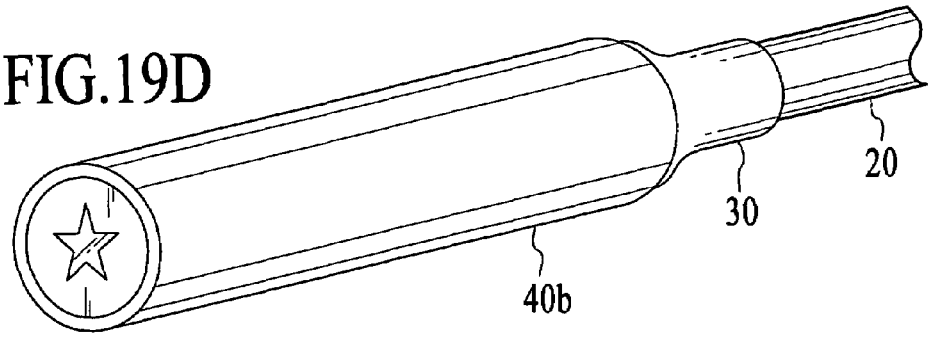

As shown in FIGS. 17 & 18, additional design elements 40*d* can be added to the secondary housing unit 20 by coupling either over or inside the sliding cylinder 30 or tubular glare shield 40, or by use of different size tubing, couplers and/or cylinders to produce alternative fixture designs and functions.

Figure 20A:
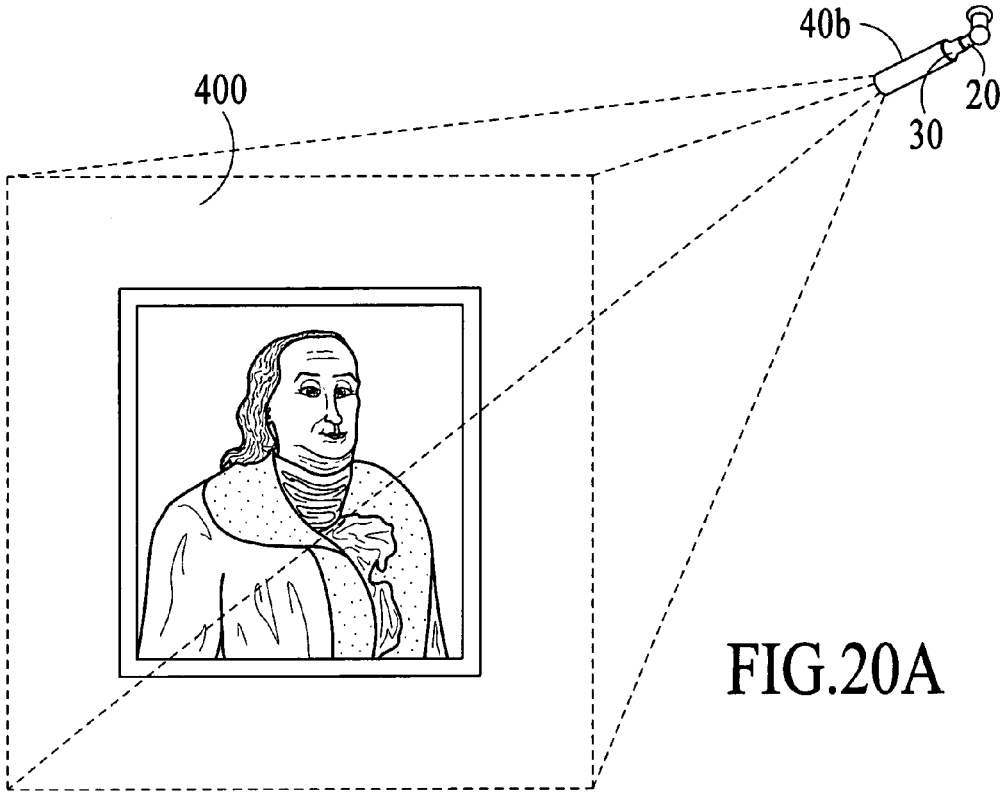
FIGS. 20A and 20B show one embodiment of method of use of the present invention 100 on hanging object(s).
Figure 20B:
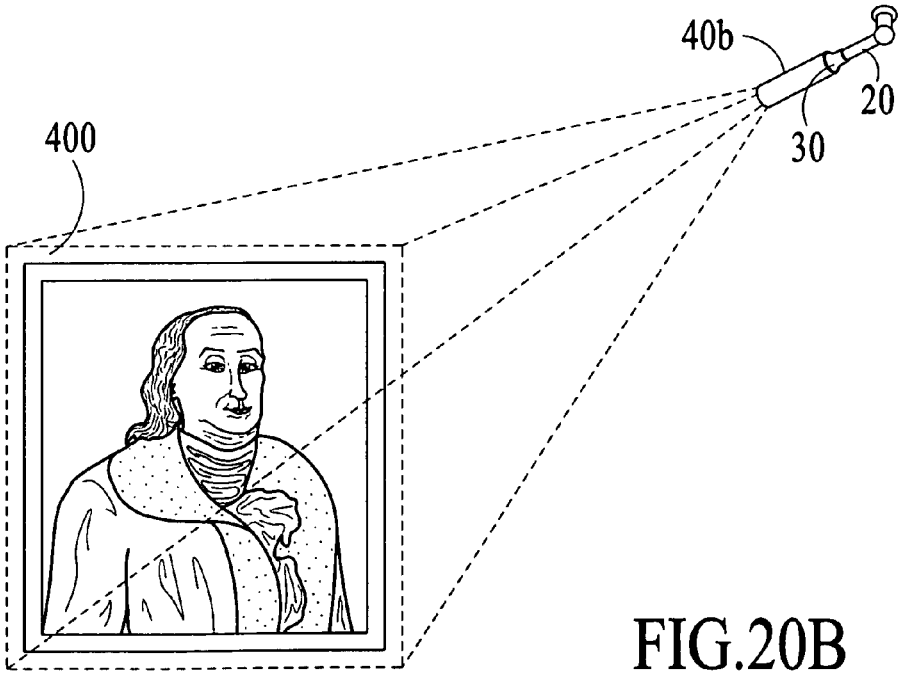

As best shown in FIG. 19A, 19B, 19C and 19D, the use of oval, rectangular or other shapes of design elements attached to the removable glare shield 40*b* can be used to achieve the corresponding desired light beam 400 pattern. As shown in FIGS. 20A and 20B, in this manner, items on a horizontal or vertical plane can be "framed" with light beam 400 from the adjustable fixture.

Figure 21A:
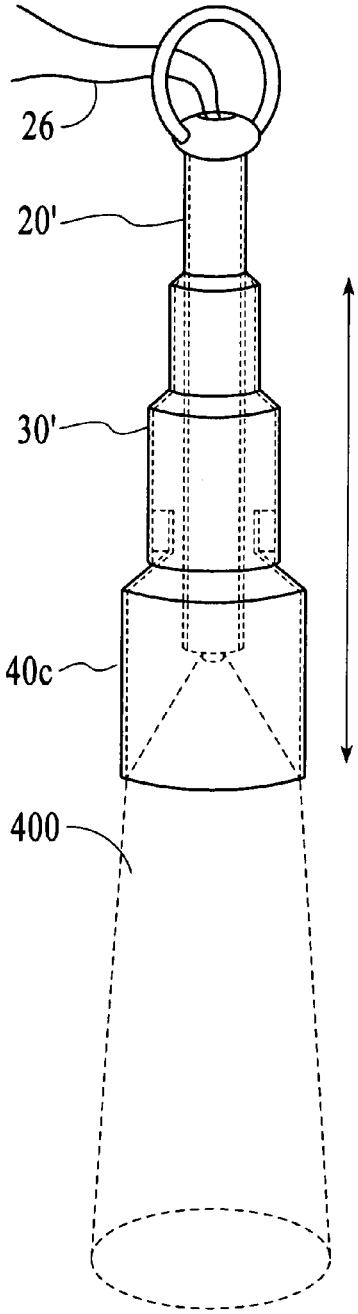
FIGS. 21A and 21B show alternative embodiment of lighting head assembly 100 each with a supplementary fixture design element 40*c* that attaches to the inside of the sliding cylinder 30 and also serves to lock the friction ring 31 in place.
Figure 21B:
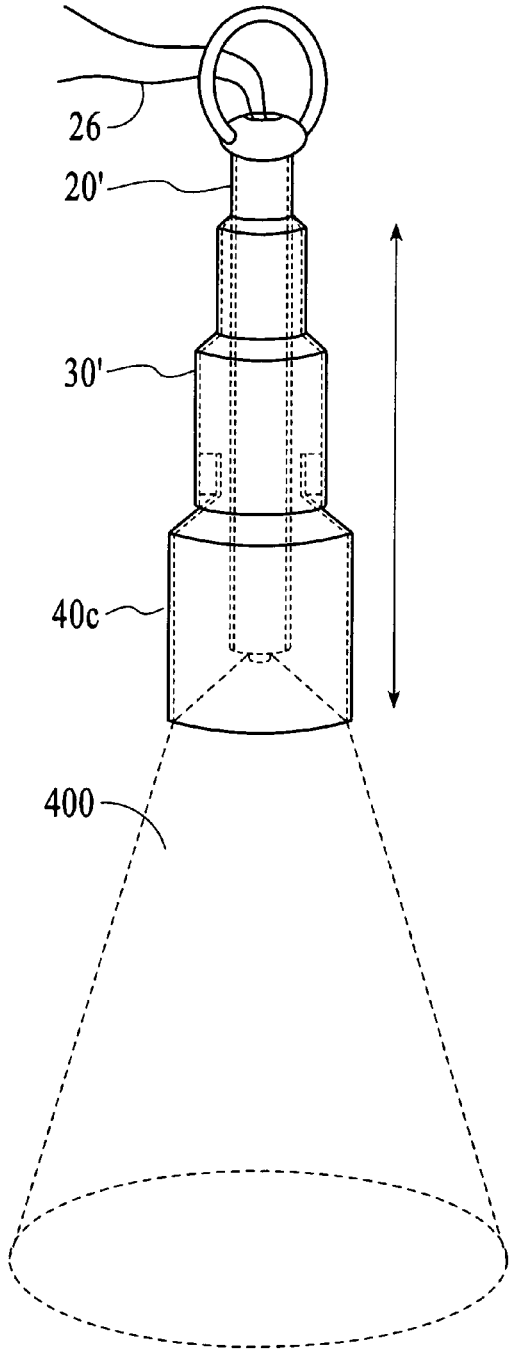

FIGS. 21A and 21B show an alternative method of controlling shape of light beam 400 by attaching supplementary fixture design element 40*c* within the sliding cylinder 30. The further away the LED unit 700 is from the opening of supplementary fixture design element 40*c*, the narrower the light beam 400, and vice versa. In this manner, user(s) can easily change the effect of light beam 400 from spot light to flood light effects.

Figure 22:
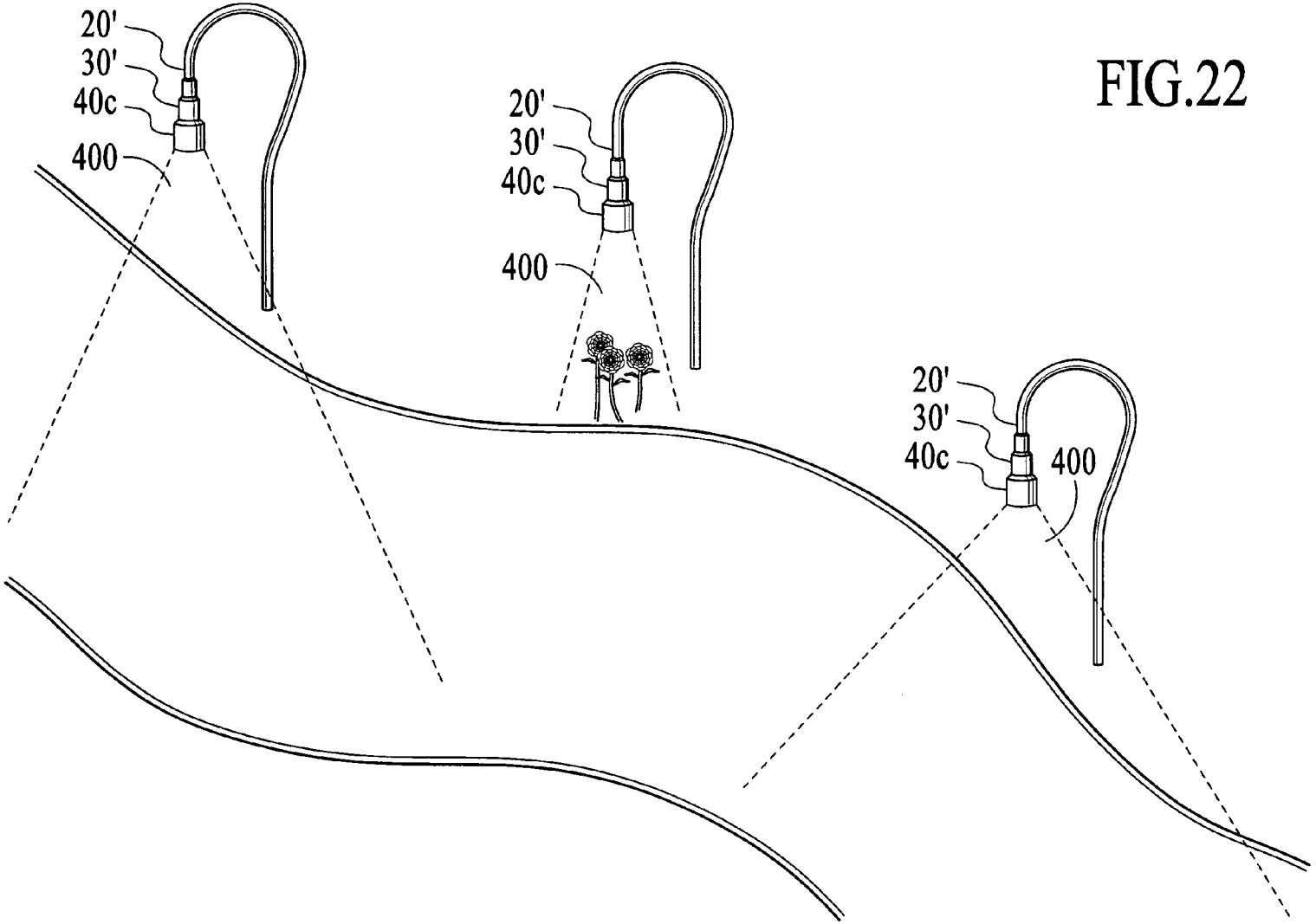
FIG. 22 shows one embodiment of another method of use of the present invention 100 on walkways.

FIG. 22 shows one embodiment of another method of use of the present invention 100 on a walkway. By altering the light beam 400 effects, user(s) can generate a desirable lighting ambiance for both practical and aesthetic purposes.

Modifications and alterations to the above described embodiments will become manifest to those skilled in the art upon reading and understanding the preceding detailed description. It is intended that the various modifications are to be within the scope of the present invention insofar as they come within the scope of the appended claims or the equivalents thereof.

In order to better utilize the advantageous features high output LED's offer, proper thermal design is imperative. The objective is to dissipate the electrical energy the LED receives that is not converted into light, to the surrounding ambient air. To achieve this, the amount of energy the final fixture design will need to dissipate should be calculated. The following shows a general outline for calculating thermal heat sink requirement of a luminaire or other LED socket touch package of the present invention 100 operating under various conditions.

Step 1) Take the manufacturer specified maximum allowable junction temperature of the LED emitter. Subtract the maximum ambient air temperature the fixture is likely to encounter and Divide by the Power Dissipated ($P_d$) of the LED as measured in Watts [Forward current ($I_f$)*Forward voltage ($V_f$)] Or:

$$R\Theta_{junction\text{-}ambient}=(T_{junction\text{-}ambient})/P_d$$

Step 2) Subtract the manufacturer specified junction thermal resistance of the LED to emitter slug 4($R\Theta_{j\text{-}b}$)

Or:

$$(R\Theta_{junction\text{-}ambient})-(R\Theta_{j\text{-}b})$$

Which will give you the amount of energy—as measured in ° Celsius (ΔT)/Watts ($P_d$), which needs to be dissipated within the exposed surface area of the heat sink of the fixture.

EXAMPLE 1

A Blue Luxeon III emitter with an average $V_f$ of 3.7 Volts, driven at 700 mA would require a heat sink that can dissipate 2.59 Watts of energy (making no adjustments for the energy that is converted to light). Assuming a maximum ambient air temperature of 40° C. (104° F.) that the designer feels the fixture is likely to encounter, and the maximum junction temperature the emitter can handle of 135° C. (varies with model of LED), and the manufacturer's specified thermal resistance of the LED emitter chip to slug of 13° C./W (as defined by the manufacturer), then $$(R\Theta_{junction\text{-}ambient})-(R\Theta_{j\text{-}b})=23.68°\ \text{C./W}$$

A luminaire or other LED socket torch package of the present invention operating under these conditions would need approximately 2 to 6 sq. inches of heat sink surface area depending on the material used and its orientation.

EXAMPLE 2

If you wanted to increase the light output of this same LED socket torch, then you could increase the current at which the LED is driven. By increasing the current from 0.700 mA to 1.0 MA, the heat sink would have to now dissipate 3.7 Watts of energy. The necessary surface area would change to 12.68° C./W which equates to anywhere from 9 to 12 sq. inches of heat sink surface area—depending on the materials used in the construction of the luminaire and its orientation.

EXAMPLE 3

If you changed the maximum temperature you want the LED's emitter junction to reach to 90° C. under the same expected conditions in order to increase the life of the LED, then driven at 1.0 mA you would have to increase the surface area of the heat sink to approximately 20 sq. inches or more.

Various strategies are available to keep the LED emitter chip 2 below its rated operating junction temperature which include: 1] Control the maximum operating ambient air temperature to be encountered by the luminaire 2] Control the orientation of the heat sink portion of the luminaire (vertical versus horizontal, etc.), 3] Manage the Power Dissipated by the LED by limiting the current applied to the LED and/or using only LED's within an allowable forward voltage range, 4] Select an appropriate heat sink material with sufficient thermal conductivity, 5] Use an LED with a higher operating temperature rating, 6] Provide sufficient heat sink surface area within the luminaire.

Of these, providing sufficient heat sink surface area and selecting appropriate heat sink materials fall within the fixture design process. For example, referring to FIG. 13 if the secondary housing unit 20 has an outside diameter of ½ inch, then the Surface Area=2*Π*radius*height or 1.57 sq. inches of Surface Area per inch of length. A sliding cylinder 30 that tapers from 0.625 to 0.875 inches and is 1½ inches long would have a Surface Area of 3.73 sq. inches and a glare shield 40 that has an outside diameter of 1 inch would have 3.14 sq. inches of Surface Area per inch of length.

Various combinations can be configured to meet surface area requirements. A luminaire requiring 10 sq. inches of heat sink surface area could be met with a secondary housing unit (20) 6½ inches in length or a combination of 4½ inches of secondary housing unit used in conjunction with the sliding cylinder 30. Using materials with better thermal conductivity (e.g. copper vs. stainless steel) can greatly effect the amount of heat sink surface area required.

Further, as temperature tolerances of next-generation high output LED's increase, heat sink requirements will be reduced—opening new design possibilities with higher current operation for increased light output. With implementation of the present invention, lighting designers will be able to incorporate a replaceable lighting assembly contained within a small footprint into various fixture designs that allow for easy adjustment of the light beam spread, pattern, color and intensity.

The present invention is a lighting head assembly having: a directional, high output, replaceable LED socket torch; a vertically aligned thermal heat sink shaft for communicating thermal energy away from the LED socket torch in a direction opposite the orientation of directionality of the LED; a cylindrical housing having a proximal end and a distal end, the proximal end for receiving and maintaining the socket torch in intimate contact with the heat sink shaft; and an electrical connection disposed within the housing for coupling the LED socket torch to an external electrical source adjacent the distal end of the cylindrical housing.

In an embodiment, the replaceable LED socket torch comprises: an LED emitter; a base portion formed of a heat-resistant material, the LED emitter coupled directly to the base portion; an essentially transparent protective covering over the LED emitter connected to the base portion; an intermediate heat sink, the heat sink in intimate contact with the base portion for providing efficient thermal conduction away from the LED emitter; a distal end having a socket connector mounting portion, thus providing a secure, releasable and reconnectable mechanical connection between the replaceable LED socket torch and the lighting head assembly; and at least two electrical leads connected to the LED emitter extending beyond the base portion, at least one of the at least two electrical leads electrically isolated from the heat sink, the at least 2 electrical leads terminating at the distal end, thus providing at least two contacts for communication of electrical energy to the lighting head assembly.

In an embodiment, of the lighting head assembly, a slidable focusing element is coupled to the housing and light torch assembly for focusing the light created by the LED emitter as desired.

In an embodiment, of the lighting head assembly, a mounting bracket is coupled to the cylindrical housing for mounting the lighting head assembly as desired The present invention is a directional, high output, replaceable LED socket torch for use in lighting applications, the LED socket torch comprising: an LED emitter having an electrically isolated base and plurality of electrical inputs; a heat sink shaft in intimate contact with the base of the LED emitter; an emitter ring for coupling the heat sink shaft to the LED emitter; a housing having a proximal end and a distal end, the LED emitter seated within the housing at the proximal end such that the heat sink shaft extends distally there within; an end socket connector seated within the distal end of the housing; and electrical contacts extending through the housing from the plurality of electrical inputs of the LED emitter to the end connector, whereby upon coupling the LED socket torch to a source of electrical energy, light is produced by the LED emitter and heat formed by the LED emitter is transferred through the base to the heat sink shaft for dissipation through the end socket connector.

In an embodiment of the LED socket torch, the electrical contacts further comprise wire prongs extending distally from the distal end of the housing.

The present invention is a lighting head assembly for providing directional, high-output illumination, the lighting head assembly having: a high output, replaceable LED socket torch comprising: an LED emitter having an electrically isolated base and plurality of electrical inputs which provides high-output beam of illumination; a vertically aligned thermal heat sink shaft in intimate contact with the base of the LED emitter for dissipating heat generated by the LED emitter; an emitter ring for maintaining the heat sink shaft in intimate contact with the LED emitter; a socket torch housing having a proximal end and a distal end, the LED emitter located adjacent the proximal end such that the heat sink shaft extends axially through at least a portion of the socket torch housing at the proximal end; an end socket quick connect-type connector located at the distal end of the socket torch housing; and electrical contacts extending through the socket torch housing from the plurality of electrical inputs of the LED emitter to the end socket connector, whereby upon coupling the LED socket torch to a source of electrical energy, light is produced by the LED emitter and heat formed by the LED emitter is transferred through the electrically isolated base to the heat sink shaft for dissipation of heat therethrough; a tubular base portion housing having a proximal end and a distal end, the proximal end for receiving and maintaining the replaceable LED socket torch; a slidable tubular coupling having a proximal end and a distal end, the distal end having a predetermined internal diameter such that the distal end is disposed in intimate contact around the tubular base portion, the slidable coupling further having a proximal end, the slidable coupling having a predetermined length such that when the slidable coupling is positioned adjacent the proximal end of the tubular base portion housing the proximal end of the slidable tubular coupling shields the glare of the beam of LED illumination and permits shaping of the beam of illumination as desired; and an electrical connection disposed within the housing for coupling the LED socket torch to an external electrical source adjacent the distal end of the cylindrical housing.

In an embodiment of the present invention, the slidable tubular coupling is adapted for coupling a glare shield portion thereto.

In an embodiment of the present invention, a glare shield portion is removably coupled to the slidable tubular coupling for shaping and directing the beam of illumination as desired.

In an embodiment of the present invention, a mechanical stop is adjacent the proximal end of the tubular base portion for preventing the slidable coupling from moving past the proximal end of the tubular base portion.

In an embodiment of the present invention, the mechanical stop comprises a cylindrical ring bonded to the proximal end of the tubular base portion.

In an embodiment of the present invention, the internal diameter of the proximal end of the slidable coupling is greater than the outside diameter of the cylindrical ring, such that the proximal end of the slidable coupling is unimpeded by the cylindrical ring mechanical stop.

In an embodiment of the present invention, the proximal end of the slidable coupling has a predetermined internal diameter greater than the predetermined internal diameter of the distal end thereof.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A lighting head assembly for providing directional, high-output illumination, the lighting head assembly having:

a high output, replaceable LED socket torch comprising:

an LED emitter having an electrically isolated base and plurality of electrical inputs which provides high-output beam of illumination;

a vertically aligned thermal heat sink shaft in intimate contact with the base of the LED emitter for dissipating heat generated by the LED emitter;

an emitter ring for maintaining the heat sink shaft in intimate contact with the LED emitter;

a socket torch housing having a proximal end and a distal end, the LED emitter located adjacent the proximal end such that the heat sink shaft extends axially through at least a portion of the socket torch housing at the proximal end;

an end socket quick connect-type connector located at the distal end of the socket torch housing; and electrical contacts extending through the socket torch housing from the plurality of electrical inputs of the LED emitter to the end socket connector, whereby upon coupling the LED socket torch to a source of electrical energy, light is produced by the LED emitter and heat formed by the LED emitter is transferred through the electrically isolated base to the heat sink shaft for dissipation of heat therethrough;

a tubular base portion housing having a proximal end and a distal end, the proximal end for receiving and maintaining the replaceable LED socket torch;

a slidable tubular coupling having a proximal end and a distal end, the distal end having a predetermined internal diameter such that the distal end is disposed in intimate contact around the tubular base portion, the slidable coupling further having a proximal end, the slidable coupling having a predetermined length such that when the slidable coupling is positioned adjacent the proximal end of the tubular base portion housing the proximal end of the slidable tubular coupling shields the glare of the beam of LED illumination and permits shaping of the beam of illumination as desired; and an electrical connection disposed within the housing for coupling the LED socket torch to an external electrical source adjacent the distal end of the cylindrical housing.

2. The lighting head assembly of claim 1 in which the slidable tubular coupling is adapted for coupling a glare shield portion thereto.

3. The lighting head assembly of claim 1 further comprising a glare shield portion removably coupled to the slidable tubular coupling for shaping and directing the beam of illumination as desired.

4. The lighting head assembly of claim 1 further comprising a mechanical stop adjacent the proximal end of the tubular base portion for preventing the slidable coupling from moving past the proximal end of the tubular base portion.

5. The lighting head assembly of claim 4 in which the mechanical stop comprises a cylindrical ring bonded to the proximal end of the tubular base portion.

6. The lighting head assembly of claim 5 in which the internal diameter of the proximal end of the slidable coupling is greater than the outside diameter of the cylindrical ring, such that the proximal end of the slidable coupling is unimpeded by the cylindrical ring mechanical stop.

7. The lighting head assembly of claim 1 in which the proximal end of the slidable coupling has a predetermined internal diameter greater than the predetermined internal diameter of the distal end thereof.

* * * * *